US007029230B2

(12) United States Patent
Jaeger

(10) Patent No.: US 7,029,230 B2
(45) Date of Patent: Apr. 18, 2006

(54) IMPELLER FOR A SIDE CHANNEL PUMP

(75) Inventor: Bernd Jaeger, Fritzlar (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/497,480

(22) PCT Filed: Oct. 14, 2002

(86) PCT No.: PCT/DE02/03898

§ 371 (c)(1),
(2), (4) Date: Jun. 2, 2004

(87) PCT Pub. No.: WO03/050419

PCT Pub. Date: Jun. 19, 2003

(65) Prior Publication Data

US 2005/0013712 A1 Jan. 20, 2005

(30) Foreign Application Priority Data

Dec. 7, 2001 (DE) ..... 101 60 199

(51) Int. Cl.
*F04D 5/00* (2006.01)

(52) U.S. Cl. ..... 415/55.1; 416/175; 416/203

(58) Field of Classification Search ..... 415/55.1, 415/55.2, 55.3, 55.4, 55.5, 55.6, 55.7, 173.1, 415/173.5; 416/175, 203
See application file for complete search history.

(56) References Cited

U.S. PATENT DOCUMENTS

| | | | | |
|---|---|---|---|---|
| 4,493,620 | A * | 1/1985 | Takei et al. | 415/55.5 |
| 5,472,321 | A * | 12/1995 | Radermacher | 415/55.6 |
| 5,607,283 | A | 3/1997 | Kato et al. | |
| 5,904,468 | A * | 5/1999 | Dobler et al. | 415/55.2 |
| 2002/0090293 | A1 * | 7/2002 | Yu et al. | 415/55.1 |

FOREIGN PATENT DOCUMENTS

| | | | |
|---|---|---|---|
| DE | 729453 | 2/1943 | |
| DE | 42 43 225 A1 | 6/1994 | |
| DE | 196 34 734 A1 | 3/1998 | |
| EP | 070529 A1 * | 1/1983 | 415/55.6 |
| WO | WO 01/98663 A1 | 12/2001 | |

* cited by examiner

*Primary Examiner*—Christopher Verdier
(74) *Attorney, Agent, or Firm*—Richard A. Speer; Mayer, Brown, Rowe & Maw, LLP

(57) ABSTRACT

An impeller for a delivery pump in which profiled section (14) comprising webs (15) is located on the outer periphery of an impeller (4) for a feed pump (2) that is configured as a side channel pump. The webs (15) are arranged at an ascending incline, viewed in the rotational direction of the impeller (4) from the designated pressure side to the designated intake side. This permits flow losses between the radial external region of the impeller (4) and the housing parts (6, 7) of the feed pump (2) to be maintained at a particularly low level.

1 Claim, 1 Drawing Sheet

IMPELLER FOR A SIDE CHANNEL PUMP

BACKGROUND OF THE INVENTION

The invention relates to an impeller for a delivery pump which constructed as a side channel pump, provided is in particular for delivering fuel in a fuel container, and which, at its ends, in each case has a ring of guide vanes bounding vane chambers spaced apart from its radially outer rim and is provided to be arranged between housing parts of the delivery pumps.

Delivery pumps for delivering fuel from fuel containers are frequently designed as side channel pumps and known from practical use. The delivery of the fuel is carried out from an inlet channel via the rings of the vane chambers and in partially annular channels arranged in the housing parts to an outlet channel. In the rings of vane chambers arranged at both ends of the impeller, a higher pressure is produced on one end than on the other end during the delivery of the fuel. This pressure difference is particularly high, especially in axial-flow side channel pumps in which the vane chambers are connected to one another.

The disadvantage with the known delivery pump is that, as a result of the pressure difference at the ends of the impeller, flow losses arise as a result of bypass flow around the outer rim of the impeller. These flow losses lead to a reduction in the efficiency of the delivery pump. Furthermore, as a result of the bypass flow, dirt particles contained in the fuel are introduced between the impeller and the housing parts. As a result, the impeller wears, in particular at its rim, which leads to a rise in the flow losses.

Consideration could be given to providing the impeller with a particularly wear-resistant layer or to keeping the tolerances between the housing parts and the impeller particularly small. However, this leads to a high fabrication outlay for the impeller.

The invention is based on the problem of configuring an impeller of the type mentioned at the beginning in such a way that flow losses and wear at the rim of the impeller are kept particularly low.

BRIEF DESCRIPTION OF THE INVENTION

According to the invention, this problem is achieved by a profiled section providing a resistance to flow being arranged at the radially outer rim.

As a result of this configuration, the bypass flow of fuel from one end to the other end is prevented. This leads, firstly, to a considerable reduction in the flow over the rim of the impeller according to the invention, and therefore to low flow losses of the delivery pump. Furthermore, as a result of the reduction in the flow over the rim of the impeller according to the invention, the ingress of dirt particles into the gap between the impeller and the housing parts is reduced considerably. This leads to particularly low wear of the impeller in its radially outer region. Flow losses in the delivery pump are therefore kept permanently low by the configuration of the impeller according to the invention. A further advantage of the invention is that flow losses in a known delivery pump can be reduced by simply replacing the impeller.

The impeller according to the invention could have a labyrinth seal, for example given a suitable configuration of the housing parts. However, this leads to a high fabrication outlay for the impeller. The impeller according to the invention is configured particularly simply in design terms if the profiled section has radially projecting webs spaced apart from one another in the peripheral direction.

A contribution to further simplifying the fabrication of the impeller according to the invention is made if the webs are arranged substantially parallel to one another.

According to another advantageous development of the invention, the profiled section is able to compensate for the pressure difference at the ends of the impeller completely if the webs are inclined with respect to the axis of rotation of the impeller. By means of this configuration, the webs are formed like guide vanes of a peripheral pump, as a result of which bypass flow of the fuel over the rim can be prevented virtually completely.

At the end of the impeller with a high pressure, the profiled section is able to produce a similarly high opposing pressure if the webs, as viewed in the direction of rotation, are inclined so as to rise from the envisaged pressure side to the envisaged suction side.

According to another advantageous development of the invention, delivery of fuel through the webs may be avoided reliably if an angle of inclination $\alpha$ of the webs with respect to the perpendicular to the ends is approximately 1° to 50°.

Noises from the delivery pump provided with the impeller according to the invention may largely be avoided if the webs are arranged distributed irregularly over the periphery.

BRIEF DESCRIPTION OF THE DRAWINGS

The invention permits numerous embodiments. In order to illustrate its basic principle further, one of these is illustrated in the drawing and will be described below. In the drawing.

DETAILED DESCRIPTION OF THE INVENTION

Figure 1:
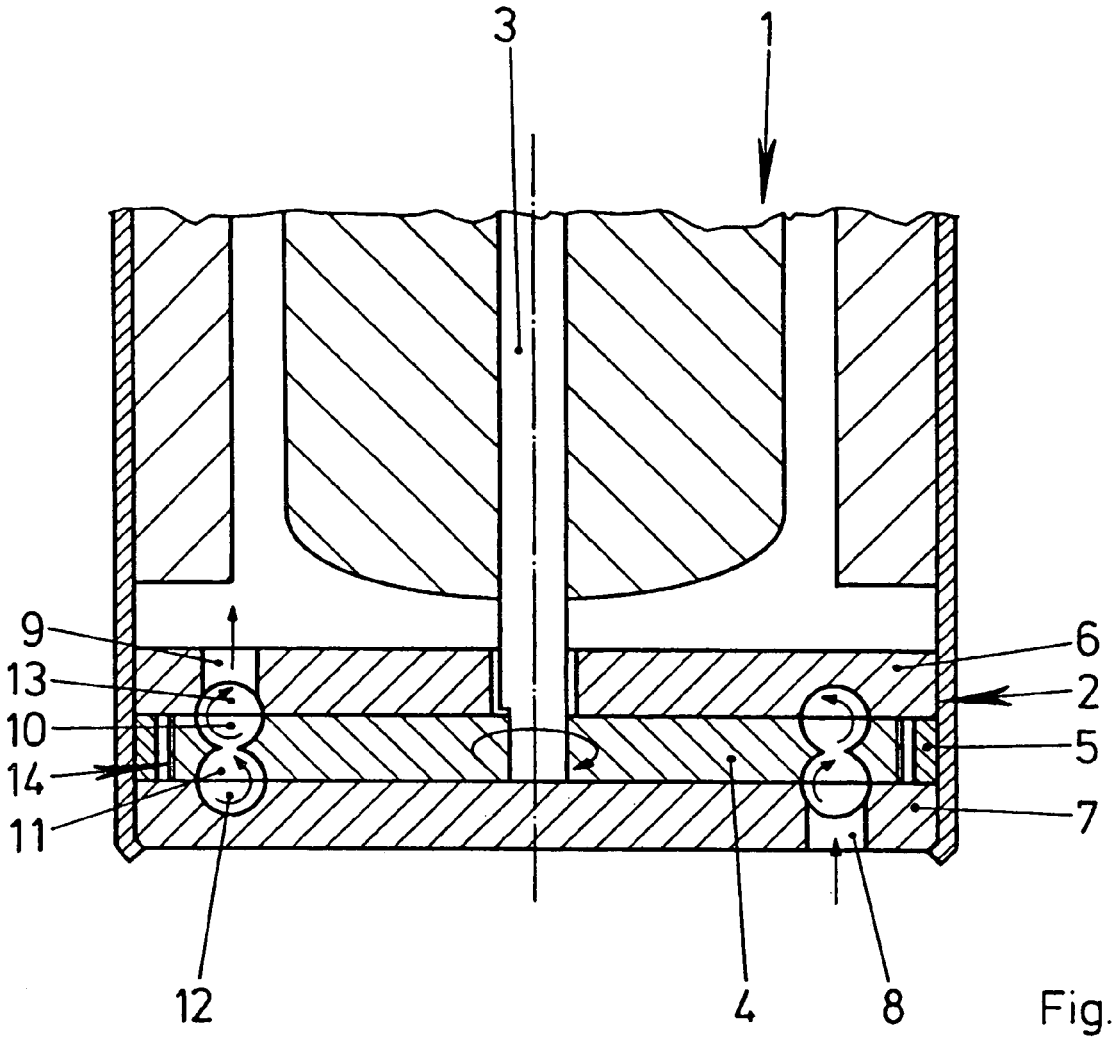
FIG. 1 shows a sectional illustration through a delivery pump with an impeller according to the invention.

FIG. 1 shows a delivery pump 2 driven by an electric motor 1 for delivering fuel in a motor vehicle. The delivery pump 2 has an impeller 4 fastened to a shaft 3 of the electric motor 1 and two housing parts 6, 7 held at a distance from each other by means of a spacer ring 5. The delivery pump 2 delivers fuel from an inlet channel 8 to an outlet channel 9 arranged on the side of the electric motor 1. In each case a ring of vane chambers 10, 11 is arranged in the ends of the impeller 4. Mutually opposite vane chambers 10, 11 are connected to one another within the impeller 4. In the region of the vane chambers 10, 11, the housing parts 6, 7 have partly annular channels 12, 13 which extend from the inlet channel 8 to the outlet channel 9. Furthermore, FIG. 1 shows that a profiled section 14 is arranged on the radially outer rim of the impeller 4.

In order to ensure unimpeded rotation of the impeller 4, the housing parts 6, 7 and the spacer ring 5 are at a slight distance from the impeller 4. During rotation of the impeller 4, circulating flows are produced in the vane chambers 10, 11 and the partly annular channels 12, 13, and therefore fuel is delivered from the inlet channel 8 to the outlet channel 9. For purposes of clarification, the direction of rotation of the impeller 4 and the flows of the fuel are identified by arrows in the drawing. When driven, a greater pressure is produced on the side of the impeller 4 facing the outlet channel 9 than on the side of the inlet channel 8. Bypass flow of fuel via a gap from the side of the outlet channel 9 to the side of the inlet channel 8 leads to flow losses. These flow losses are reduced by the profiled section 14 arranged on the rim.

Figure 2:
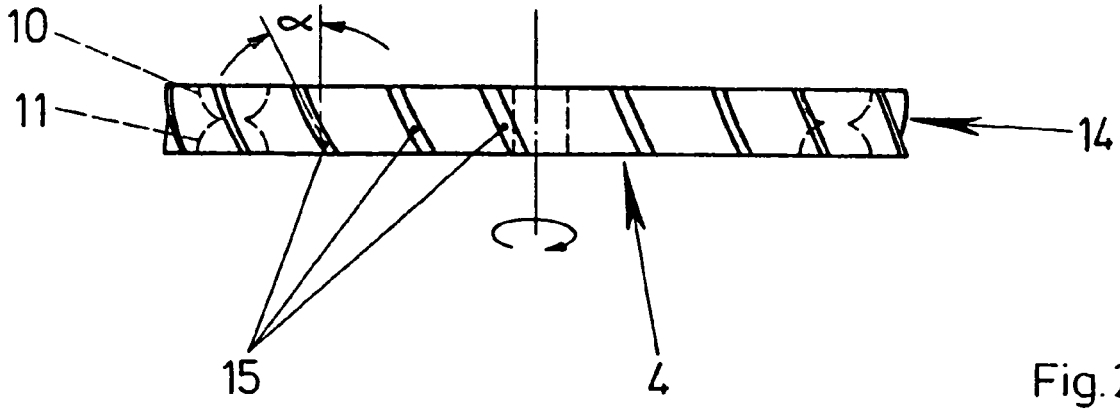
FIG. 2 shows a view of the rim of the impeller according to the invention from FIG. 1.

FIG. 2 shows the impeller 4 in the installed position described in FIG. 1 in a view of the rim. For the purpose of clarification, the envisaged direction of rotation is identified by an arrow. It can be seen here that the profiled section 14 has webs 15 spaced apart from one another in peripheral direction projecting from the rim. The webs 15 are arranged inclined at an angle $\alpha$ with respect to the perpendicular to the impeller 4. The angle $\alpha$ is approximately 40° in the exemplary embodiment illustrated. As viewed in the direction of rotation, the webs 15 are inclined so as to rise from the pressure side, to be arranged close to the outlet channel 9 of the delivery pump 2 from FIG. 1, to the suction side, envisaged to be arranged close to the inlet channel 8. Furthermore, the webs 15 are arranged distributed irregularly over the periphery of the impeller 4.

The invention claimed is:

1. An impeller for a delivery pump which is constructed as a side channel pump is provided for delivering fuel in a fuel container and which, at its ends, in each case has a ring of guide vanes bounding vane chambers spaced apart from its radially outer rim and is provided to be arranged between housing parts of the delivery pump, wherein a profiled section having radially projecting webs distributed irregularly over the periphery is arranged at the radially outer rim.

* * * * *